US008976011B2

(12) United States Patent
Kuo et al.

(10) Patent No.: US 8,976,011 B2
(45) Date of Patent: Mar. 10, 2015

(54) CIRCUIT BOARD STRUCTURE

(71) Applicant: Wistron NeWeb Corporation, Hsinchu (TW)

(72) Inventors: Hsiang-Chen Kuo, Hsinchu (TW); Tsung-Hsing Tsai, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 289 days.

(21) Appl. No.: 13/753,534

(22) Filed: Jan. 30, 2013

(65) Prior Publication Data

US 2014/0167937 A1 Jun. 19, 2014

(30) Foreign Application Priority Data

Dec. 19, 2012 (TW) ..... 101224571 U

(51) Int. Cl.
*G08B 9/00* (2006.01)
*G08B 1/08* (2006.01)
*H04H 40/90* (2008.01)

(52) U.S. Cl.
CPC . *G08B 1/08* (2013.01); *H04H 40/90* (2013.01)
USPC ..... 340/286.02; 340/286.01

(58) Field of Classification Search
CPC ..... G08B 1/08; H04H 40/90
USPC ..... 340/286.02
See application file for complete search history.

(56) References Cited

U.S. PATENT DOCUMENTS

| | | | | |
|---|---|---|---|---|
| 7,826,791 | B2 * | 11/2010 | Green et al. | 455/3.02 |
| 2006/0052053 | A1 * | 3/2006 | Kozaki et al. | 455/3.02 |
| 2009/0009399 | A1 | 1/2009 | Gaucher | |
| 2009/0159320 | A1 | 6/2009 | Sanjuan | |
| 2012/0051000 | A1 | 3/2012 | Laidig | |
| 2013/0078938 | A1 * | 3/2013 | Motoyama | 455/311 |

FOREIGN PATENT DOCUMENTS

| | | | |
|---|---|---|---|
| EP | 1 298 759 | A2 | 4/2003 |
| EP | 1 298 759 | A3 | 8/2003 |
| WO | 2004006382 | A1 | 1/2004 |

OTHER PUBLICATIONS

Kavita Goverdhanam et al., Novel Three-Dimensional Vertical Interconnect Technology for Microwave and RF Applications, TU4A-5, 1999 IEEE MTT-S Digest, pp. 641-644, XP010343427, 1999.

* cited by examiner

*Primary Examiner* — Kerri McNally
(74) *Attorney, Agent, or Firm* — Winston Hsu; Scott Margo

(57) ABSTRACT

A circuit board structure for a low noise block down-converter is disclosed. The circuit board structure is used for transmitting a first radio-frequency signal and a second radio-frequency signal across each other, and includes a first substrate and a second substrate. The first substrate includes a first wire for transmitting the first radio-frequency signal, a first grounded wire formed in parallel to a side of the first wire, and a second grounded wire formed in parallel to another side of the first wire. The second substrate is electrically connected to the first substrate, and includes a second wire for transmitting the second radio-frequency signal, a third wire formed on a side of the second wire and a fourth wire formed on another side of the second wire.

16 Claims, 10 Drawing Sheets

CIRCUIT BOARD STRUCTURE

BACKGROUND OF THE INVENTION

1. Field of the Invention

The present invention relates to a circuit board structure for a low noise block down-converter, and more particularly, to a circuit board structure capable of transmitting two radio-frequency signals across each other.

2. Description of the Prior Art

A satellite communication receiver may include a dish reflector and an LNBF (Low Noise Block Down-converter with Feedhorn). The LNBF is used for gathering satellite signals reflected by the dish reflector and converting the satellite signals into intermediate signals, and then transmitting the intermediate signals to a backend satellite signal processor for signal processing, thereby enabling the playing of satellite television programs.

Please refer to FIG. 1, which is a structural circuit diagram of a conventional LNB (Low Noise Block down-converter) 10. The LNB 10 has a function of outputting dual signals for two users. The LNB 10 includes LNAs (Low Noise Amplifiers) 101-112, power dividers 121-124, filters 131 and 132, mixers 141 and 142, oscillators 151-154 and a cross structure 160. Connection relations between the elements comprised in the LNB 10 are shown in FIG. 1.

In operation, when the satellite signals are received by the LNB 10, the satellite signals may be separated into an RF (Radio-Frequency) signal SV and an RF signal SH according to different polarizations, wherein the RF signal SV is vertically polarized and the RF signal SH is horizontally polarized. Operating voltages of the LNB 10 may be switched to control the elements comprised in the LNB 10 to perform signal processing on the RF signals SV and SH. The operating voltages for respectively processing the RF signals SV and SH are 13 volts and 18 volts. As the RF signal SV entered the LNB 10, the RF signal SV may be amplified by the LNAs 101 and 102 for two levels of signal amplification first, power divided by the power divider 121, and then part of the RF signal SV is amplified by the LNA 103 and the rest of RF signal SV is transmitted to the LNA 109 to be amplified by the LNA 109. Output terminals of the LNAs 103 and 104 may be coupled together to synthesize the RF signals SV and SH into a synthesized RF signal SVH1, the RF signal SVH1 may be amplified by the LNA 105, filtered by the filter 131, and mixed with a local oscillate signal L1 or L2 by the mixer 141, so that the RF signal SVH1 may be down converted into an IF (Intermediate Frequency) signal S1.

Likewise, as the RF signal SH enters the LNB 10, the RF signal SH may be amplified by the LNAs 107 and 108 for two levels of signal amplification first, power divided by the power divider 123, and then part of the RF signal SH is amplified by the LNA 110 and the rest of RF signal SH is transmitted to the LNA 104 to be amplified by the LNA 104. Output terminals of the LNAs 109 and 110 may be coupled together to synthesize the RF signals SV and SH into a synthesized RF signal SVH2, the RF signal SVH2 may be amplified by the LNA 111, filtered by the filter 132, mixed with a local oscillating signal L1 or L2 by the mixer 142, so that the RF signal SVH2 may be down converted into an IF signal S2.

In such a structure, the LNB 10 may control operations of the oscillators 151-154 to respectively generate the local oscillating signals L1 and L2. Or, the LNB 10 may further control the power dividers 122 and 124 to adjust signal intensities of the local oscillating signals L1 and L2, so as to generate the IF signals S1 and S2 having different operating frequencies. For example, the following equations are down-conversion formulas of the LNB 10 for a Ku operating band: (Unit:GHz)

$$SV/SH(10.7-12.75)-L1(9.75)=S1(0.95-3.0)$$

$$SV/SH(10.7-12.75)-L2(10.6)=S2(0.1-2.15)$$

Please refer to FIG. 2, which is an appearance diagram of the LNB 10. The LNB 10 includes circuit boards 11 and 12, spacers 13 and 14, a housing 15, output ports P1 and P2 and a plurality of thru pins 16. The circuit boards 11 and 12 are respectively disposed on two sides of the housing 15, the circuit boards 11 and 12 may be disposed with circuits or elements shown in FIG. 1 for performing signal process. The spacers 13 and 14 are respectively disposed on the circuit board 11 and 12 for covering the circuit boards 11 and 12. The thru pins 16 may penetrate through the circuit boards 11 and 12 and the housing 15 for transmitting signals flowing between the circuit boards 11 and 12. The output ports P1 and P2 are coupled to the circuit board 11 for respectively outputting the IF signals S1 and S2 to the backend satellite signal processor (not shown in FIG. 2).

However, since operating frequencies of the satellite signals, i.e. the RF signals SV and SH and the IF signals S1 and S2 are high, a return loss and an insertion loss of the RF signals SV and SH may be increased in the structure shown in FIG. 2. Specifically, a characteristic impedance of the thru pins 16 may be different from characteristic impedances of the circuit boards 11 and 12, and thus the RF signals SV and SH may flow across discontinuous impedances between the thru pins 16 and the circuit boards 11 and 12, which may increase the return loss and the insertion loss of the RF signals SV and SH.

Moreover, an isolation between any two thru pins 16 may be low, which may cause the RF signal flowing on the two thru pins 16 to interfere with each other by coupling or radiation, i.e. signal crosstalk. For example, except for the RF signals SV and SH, other signals such as the IF signals S1 and S2 and the local oscillating signals L1 and L2 may be viewed as a noise source and radiated by the thru pins 16 due to signal reflection or signal leak. In FIG. 1, assume the mixer 141 utilizes the local oscillating signal L2 generated by the oscillator 152 to mix with the RF signal SVH1. However, the local oscillating signal L1 generated by the oscillator 153 flows from the mixer 142, the filter 132, the LNAs 111 and 109 to the LNAs 104 and 105 at the cross structure 160 by coupling, and goes flowing to the filter 131 and finally the mixer 141. In such a situation, the IF signal S1 generated by the LNB 10 may include noises generated by mixing the local oscillating signal L1 with the local oscillating signal L2. The noise may be described as the following equation: (Unit:GHz)

$$L1(10.6)-L2(9.75)=0.85$$

To eliminate the frequency 0.85 GHz and its harmonic frequency 1.7 GHz, an additional filter may be required or a change in the specification of the filter 131, which may increase a difficulty to design the LNB 10 and a production cost as well.

On the other hand, for a production process, it may take a lot of work or time to assemble the thru pins. Besides, two circuit boards and two spacers may increase a weight of the LNB 10, which not only increases the production cost and also increases a difficulty for installing a satellite television system. Therefore, there is a need to improve the prior art.

SUMMARY OF THE INVENTION

It is therefore an object of the present invention to provide a circuit board structure for a low noise block down-converter for transmitting two radio-frequency signals across each other and improve the above mentioned problem.

The present invention discloses a circuit board structure for a low noise block down-converter, and used for transmitting a first radio-frequency signal and a second radio-frequency signal across each other, including a first substrate including a first wire for transmitting the first radio-frequency signal, a first grounded wire formed in parallel to one side of the first wire, two ends of the first grounded wire are respectively electrically connected to a first via and a second via, and a second grounded wire formed in parallel to another side of the first wire, two ends of the second grounded wire are respectively electrically connected to a third via and a fourth via, and a second substrate electrically connected to the first substrate, and including a second wire for transmitting the second radio-frequency signal, a third wire formed on one side of the second wire, and electrically connected to one end of the first wire by a fifth via to transmit the first radio-frequency signal, and a fourth wire formed on another side of the second wire, and electrically connected to another end of the first wire by a sixth via to transmit the first radio-frequency signal, wherein the third wire and the fourth wire are indirectly connected to each other, and the first, second, third, fourth, fifth and sixth vias penetrate the first substrate and the second substrate.

The present invention further discloses a low noise block down-converter, including a circuit board structure for a low noise block down-converter, and used for transmitting a first radio-frequency signal and a second radio-frequency signal across each other, including a first substrate including a first wire for transmitting the first radio-frequency signal, a first grounded wire formed in parallel to one side of the first wire, two ends of the first grounded wire are respectively electrically connected to a first via and a second via, and a second grounded wire formed in parallel to another side of the first wire, two ends of the second grounded wire are respectively electrically connected to a third via and a fourth via, and a second substrate electrically connected to the first substrate, and including a second wire for transmitting the second radio-frequency signal, a third wire formed on one side of the second wire, and electrically connected to one end of the first wire by a fifth via to transmit the first radio-frequency signal, and a fourth wire formed on another side of the second wire, and electrically connected to another end of the first wire by a sixth via to transmit the first radio-frequency signal, and a housing for covering the circuit board structure, wherein the third wire and the fourth wire are indirectly connected to each other, and the first, second, third, fourth, fifth and sixth vias penetrate the first substrate and the second substrate.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
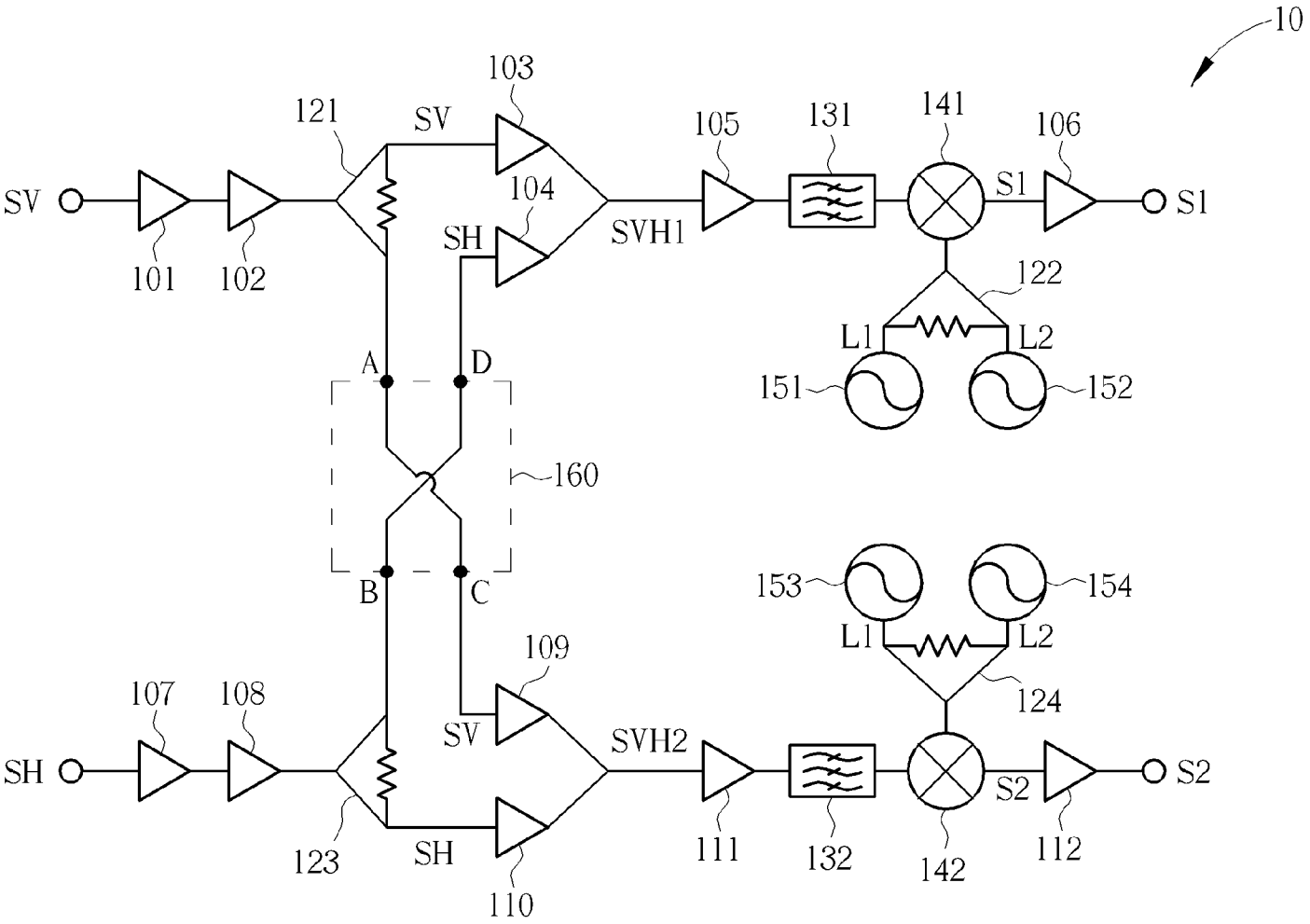
FIG. 1 PRIOR ART
FIG. 1 is a structural circuit diagram of a conventional LNB.
Figure 3A:
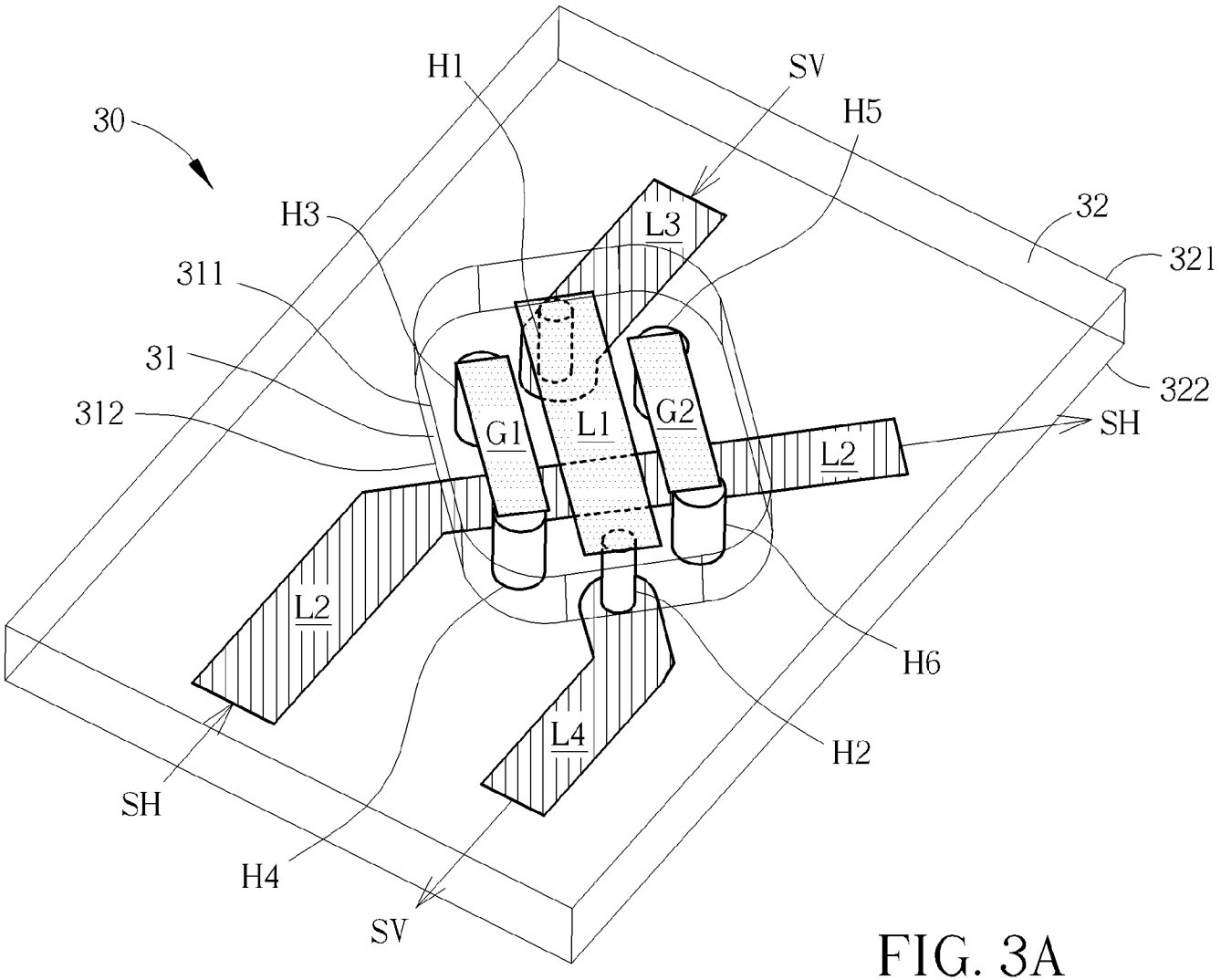
FIG. 3A to FIG. 3C are respectively a perspective view, a bottom view and a top view of a circuit board structure according to an embodiment of the present invention.
Figure 3B:
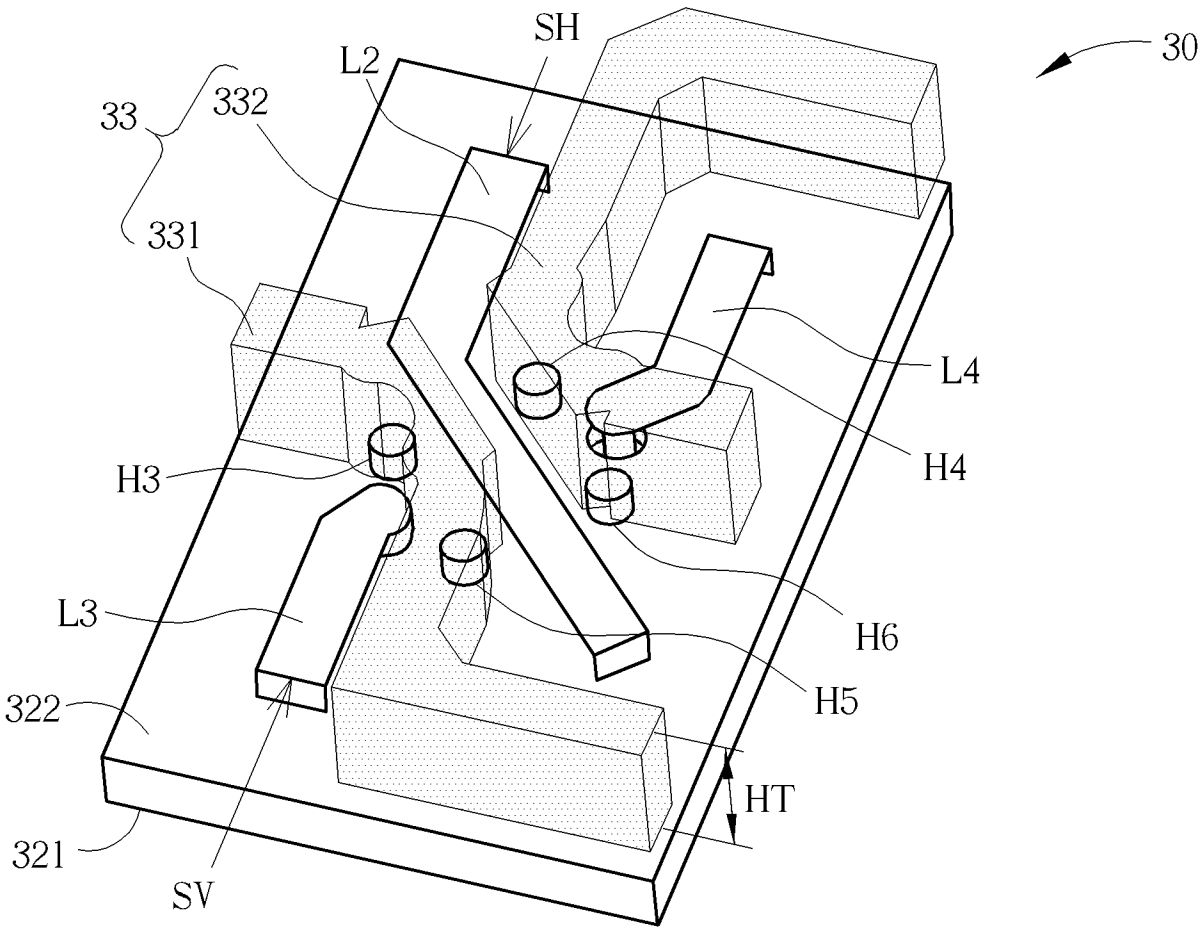
Figure 3C:
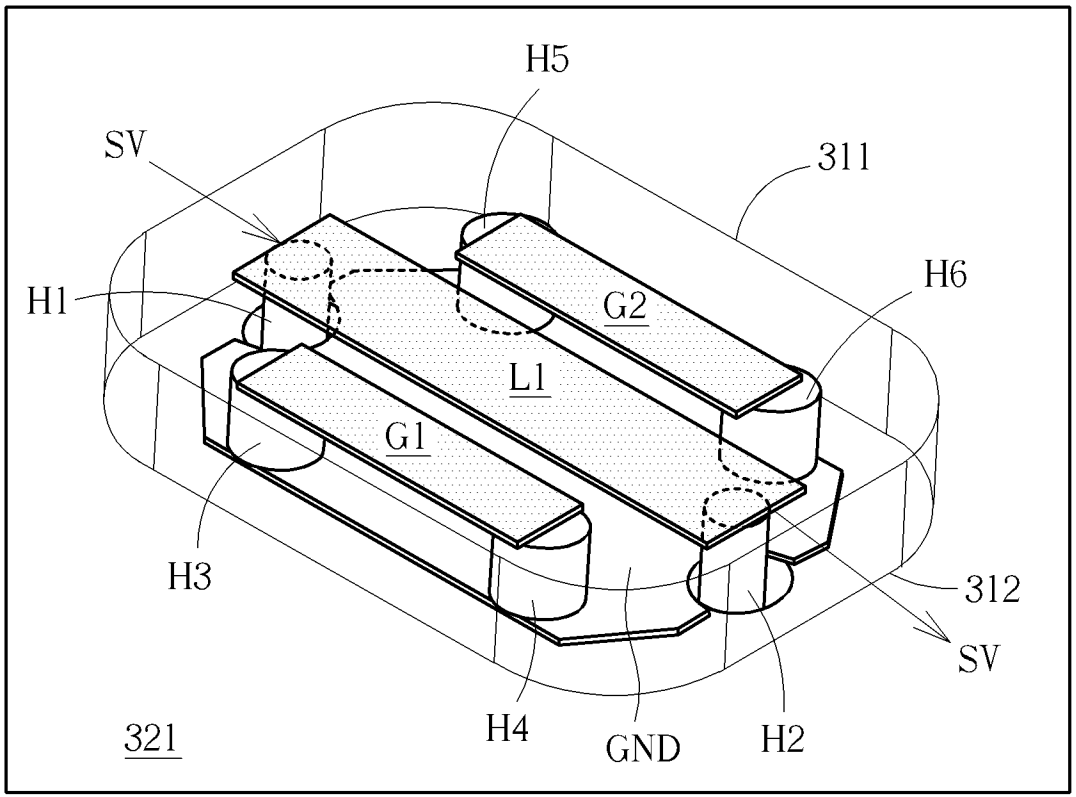

Please refer to FIG. 3A to FIG. 3C, which are a perspective view, a bottom view and a top view of a circuit board structure 30 according to an embodiment of the present invention, respectively. The circuit board structure 30 may be utilized in the cross structure 160 of the LNB 10 shown in FIG. 1 for transmitting the RF signals SV and SH across each other. The circuit board structure 30 includes a plurality of vias H1-H6, a first substrate 31 and a second substrate 32. The first substrate 31 includes a first surface 311, a second surface 312, a first wire L1, a first grounded wire G1 and a second grounded wire G2. The second substrate includes a first surface 321, a second surface 322, a second wire L2, a third wire L3 and a fourth wire L4.

In detail, the first wire L1 is used for transmitting the RF signal SV. The first grounded wire G1 is formed paralleled to one side of the first wire L1, two ends of the first grounded wire G1 are respectively electrically connected to the via H3 and the via H4. The second grounded wire G2 is formed paralleled to another side of the first wire L1, two ends of the second grounded wire G2 are respectively electrically connected to the via H5 and the via H6. The first wire L1, the first grounded wire G1 and the second grounded wire G2 are formed on the first surface 311. The first grounded wire G1 is electrically connected to a ground (not shown in FIG. 3A) of the second substrate 32 by the via H3 and the via H4, the second grounded wire G2 is electrically connected to the ground of the second substrate 32 by the via H5 and the via H6. The second wire L2 is used for transmitting the RF signal SH. The third wire L3 is formed on one side of the second wire L2, and electrically connected to one end of the first wire L1 by the via H1 to transmit the RF signal SV. The fourth wire L4 may be formed on another side of the second wire L2, and electrically connected to another end of the first wire L1 by the via H2 to transmit the RF signal SV. The second wire L2, the third wire L3 and the fourth wire L4 may be formed on the second surface 322 of the second substrate 32.

In other words, in the cross structure 160, a signal path from a node B to a node C may be regarded as the second wire L2 of the circuit board structure 30, and a signal path from a node A to a node D may be regarded as the third wire L3, the first wire L1 and the fourth wire L4 of the circuit board structure 30. Since the third wire L3 and the fourth wire L4 are indirectly connected to each other, two ends of the first wire L1 may be connected between the third and fourth wires L3 and L4 by the vias H1 and H2, such that the circuit board structure 30 may be able to transmit the RF signal SV (the nodes A to C) and RF signal SH (the nodes B to D) across each other.

Figure 2:
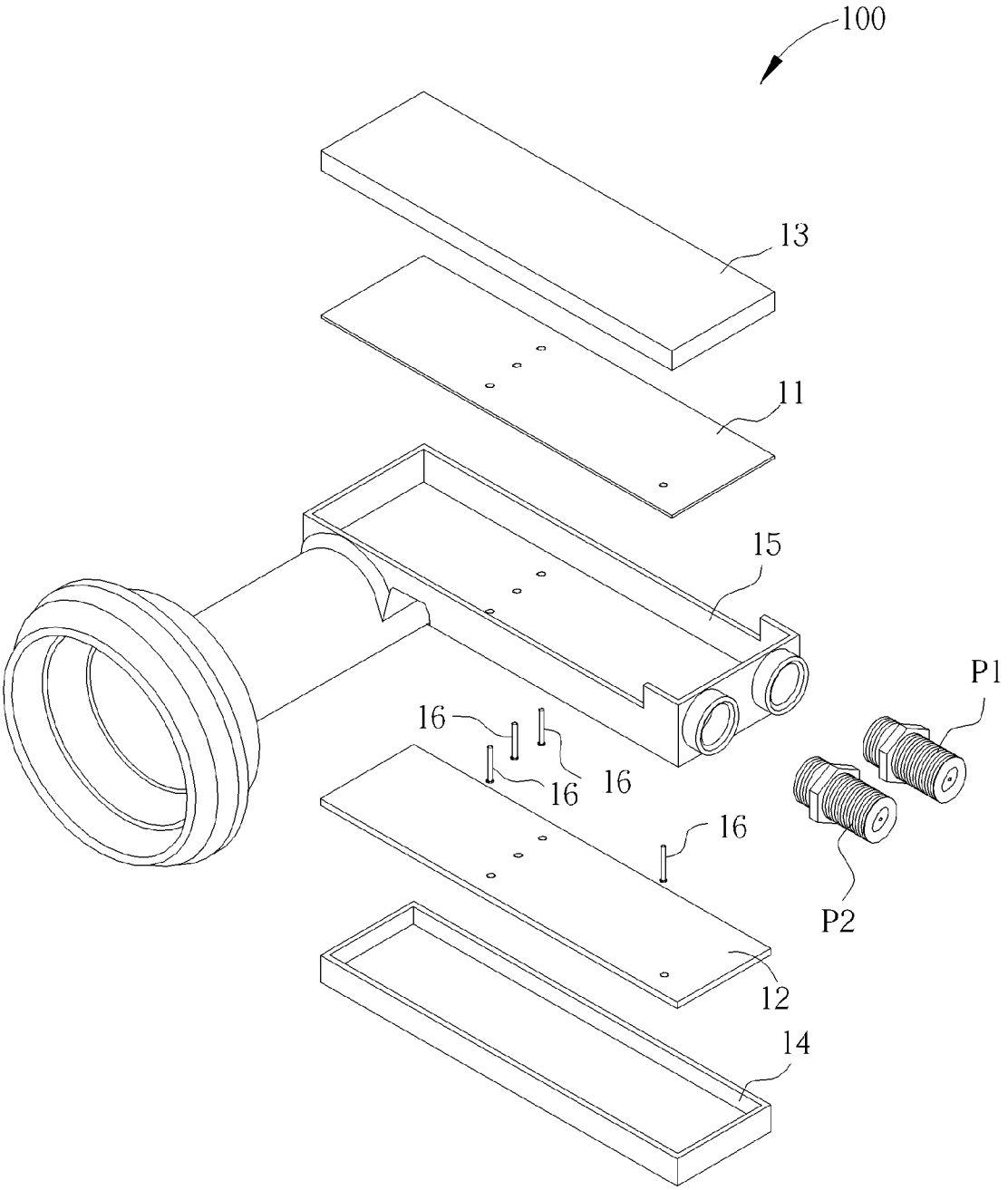
FIG. 2 PRIOR ART
FIG. 2 is an appearance diagram of the LNB shown in FIG. 1.

As a result, the vias H1-H6 may be substituted for the thru pins 16 shown in FIG. 2, the vias H1-H6 may penetrate through the first substrate 31 and the second substrate 32, the vias H1 and H2 may be viewed as signal transmission lines between the first substrate 31 and the second substrate 32 to transmit the RF signal SV. When the RF signal SV is transmitted from the second substrate 32 to the first substrate 31, the vias H3-H6 and the first and second grounded wires G1 and G2 may be viewed as a reference ground of the RF signal SV, such that the RF signal SV may reference a continuous ground even though the RF signal SV is flowing between two layers, which may uniform impedances and decrease return losses of the signal transmission lines for transmitting the RF signal SV. Moreover, the circuit board structure 30 may be designed according to CoPlanar Waveguide principles, so that a designer may adjust a wire width and a dielectric coefficient of the substrate to design a proper transmission line and ensure a uniform and continuous characteristic impedance of the transmission line. In production, the first substrate 31 can be electrically connected to second substrate 32 by a surface mount technology. The second substrate 32 may be viewed as a mother board, and the first substrate 31 may be viewed as a daughter board. The first and second substrates 31 and 32 may be made of a same raw substrate to have a same dielectric coefficient, which may save a cost for producing circuit boards, time and labor for assembling the thru pins 16, as well as ensure a stability of production.

Please refer to FIG. 3B, a spacer 33 may be disposed on the second surface 322 of the second substrate 32 to enhance isolations and mitigate the electromagnetic radiations between the second wire L2, the third wire L3 and the fourth wire L4. The spacer 33 includes separation units 331 and 332. The separation unit 331 may be formed between the second wire L2 and the third wire L3, electrically connected to one end of the first grounded wire G1 by the via H3, and electrically connected to one end of the second grounded wire G2 by the via H5. The separation unit 332 may be formed between the second wire L2 and the fourth wire L4, electrically connected to another end of the first grounded wire G1 by the via H4, and electrically connected to another end of the second grounded wire G2 by the via H6. The separation units 331 and 332 have a height HT, e.g. 2 mm, such that the separation unit 331 and 332 may be able to shield or block the electromagnetic radiations between the RF signals SH and SV. As a result, the separation units 331 and 332 may be used for shielding or blocking the electromagnetic radiations between the RF signal SV and the RF signal SH to prevent the RF signal SV and RF signal SH from interfering with each other.

Please refer to FIG. 3C, a grounded area GND may be formed on the second surface 312 of the first substrate 31. The grounded area GND may be electrically connected to the separation units 331 and 332 (not shown in FIG. 3C) by the vias H3-H6. Besides, the grounded area GND, which may be viewed as a ground of the second substrate 32, may be formed on the first surface 321 of the second substrate 32, and electrically connected to the separation units 331 and 332 by the vias H3-H6. In other words, as long as the grounded area GND is electrically connected to the vias H3-H6, the grounded area GND may shield or block the electromagnetic radiations between the RF signals SV and RF signal SH.

Figure 4A:
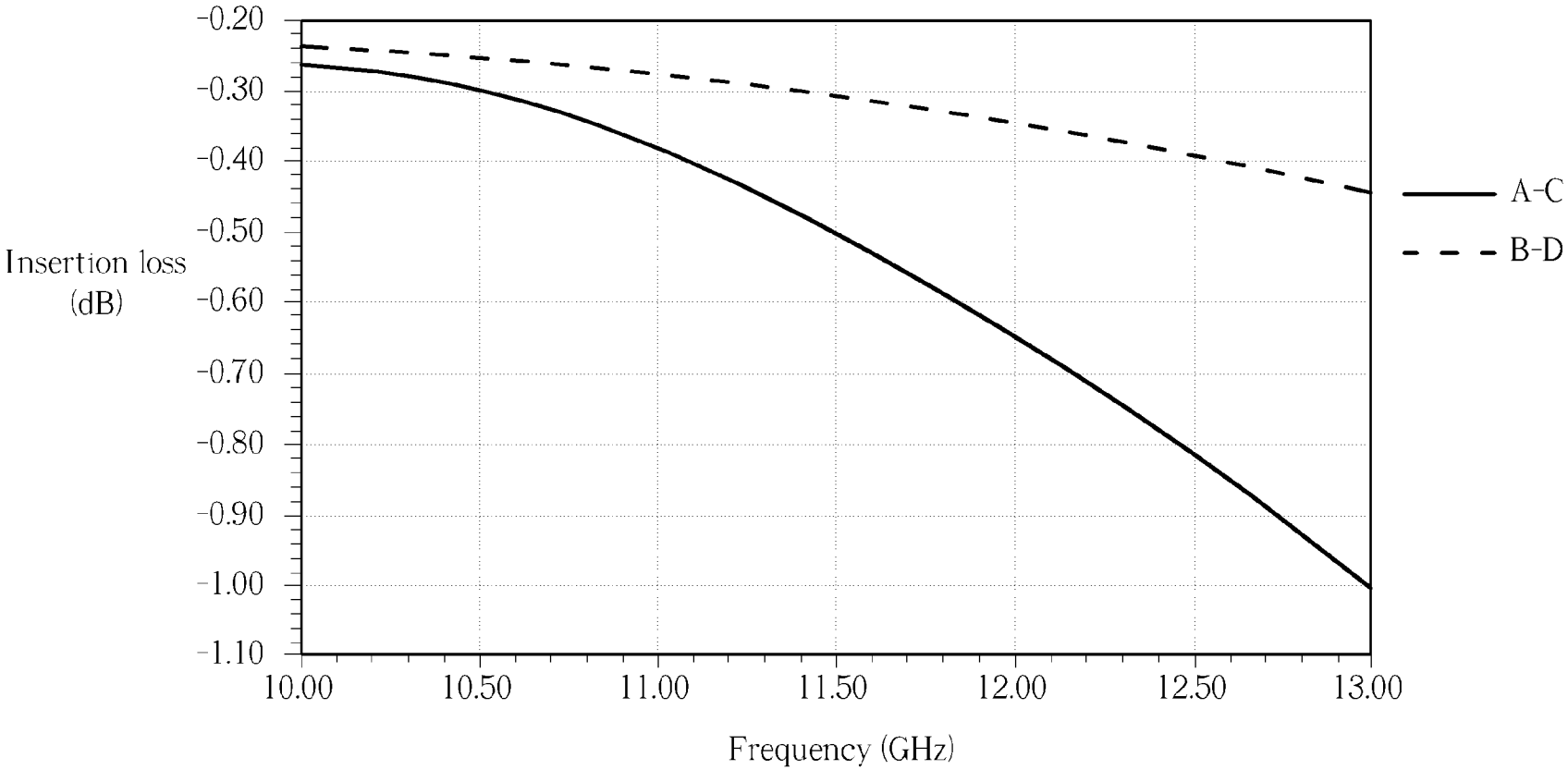
FIG. 4A to FIG. 4C are schematic diagrams of simulations of insertion losses, isolations and return losses of the circuit board structure shown in FIG. 3.
Figure 4B:
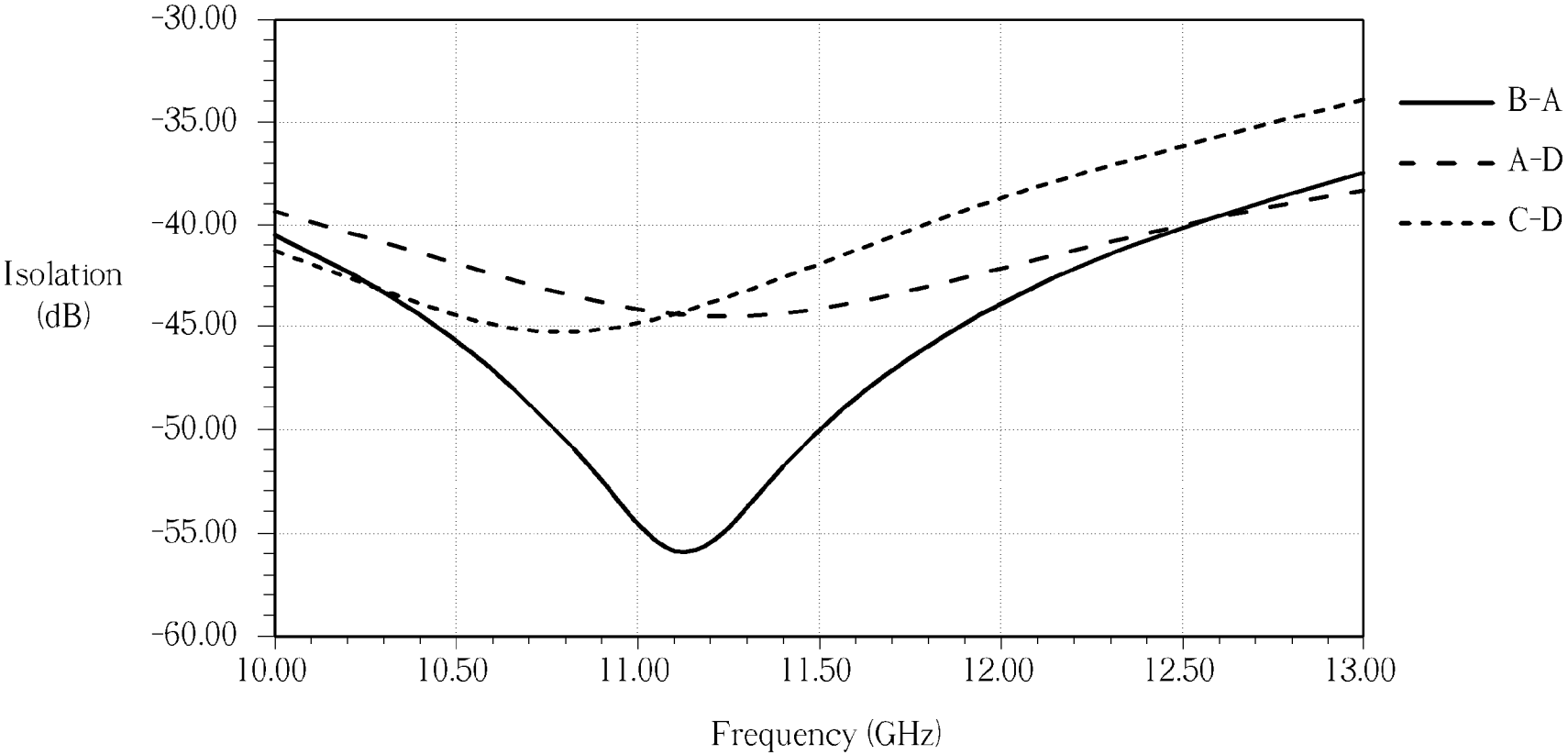
Figure 4C:
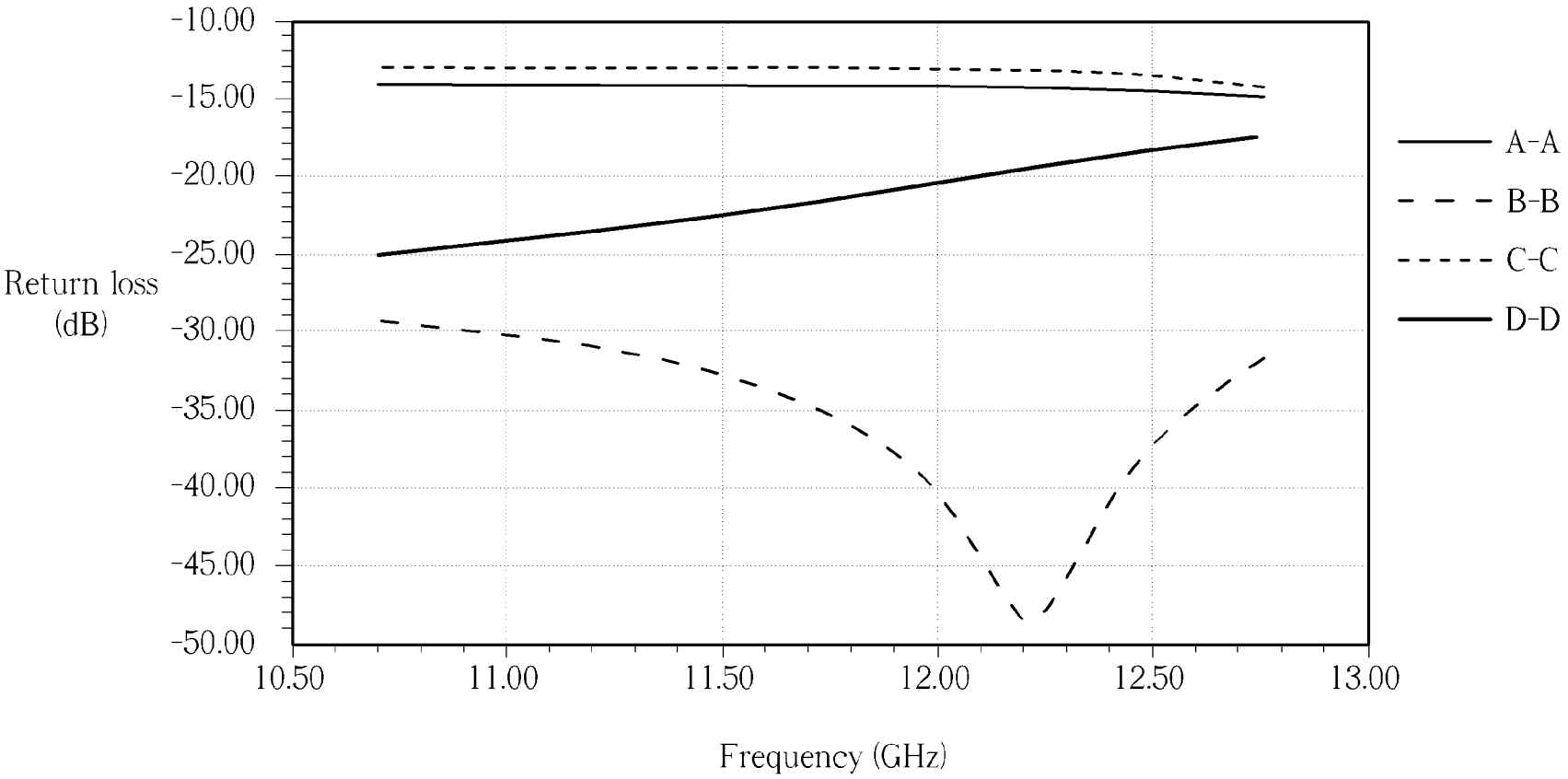

Please refer to FIG. 4A to FIG. 4C, which are schematic diagrams of simulations of insertion losses, isolations and return losses of the circuit board structure 30. In FIG. 4A, the insertions loss between nodes A and C, which is a signal route of the RF signal SV, is denoted with a solid line, the insertions loss between nodes B and D, which is a signal route of the RF signal SH, is denoted with a dashed line. Table 1 includes measurement data shown in FIG. 4A:

TABLE 1

| Frequency | A-C | | B-D | |
|---|---|---|---|---|
| (GHz) | dB | % | dB | % |
| 10.7 | −0.33 | 93 | −0.26 | 94 |
| 12.75 | −0.91 | 81 | −0.41 | 91 |

As can be seen from Table 1, the circuit board structure 30 has low insertion losses in the operating frequency band 10.7-12.75 GHz. There is at least 81% of the RF signal SV may pass through the circuit board structure 30, and there is at least 91% of the RF signal SH may pass through the circuit board structure 30.

In FIG. 4B, the isolation between the nodes B-A is denoted with a solid line, the isolation between the nodes A-D is denoted with a dashed line, the isolation between the nodes C-D is denoted with a dotted line. Table 2 includes measurement data shown in FIG. 4B:

TABLE 2

| Frequency (GHz) | B-A (dB) | A-D (dB) | C-D (dB) |
|---|---|---|---|
| 10.7 | −50.0 | −43.2 | −45.2 |
| 12.75 | −38.7 | −39.2 | −35.2 |

As can be seen from Table 2, the circuit board structure 30 has high isolations in the operating frequency band 10.7-12.75 GHz. The values of isolation between the nodes B-A, A-D, C-D are all less than −35.2 dB, which indicates there are less than 0.03% signals flowing between the nodes B-A, A-D, C-D.

In FIG. 4C, the return loss of the node A is denoted with a solid line, the return loss of the node B is denoted with a dashed line, the return loss of the node C is denoted with a dotted line, the return loss of the node D is denoted with a bold-faced line. The return losses of the node C at frequencies 10.7 GHz and 12.75 GHz are respectively −13.2 dB and −14.2 dB, which indicates there are 4.7% and 3.8% of the RF signal reflected at the node C. The return losses of the nodes A, B and D are less than the return loss of the node C.

Figure 5A:
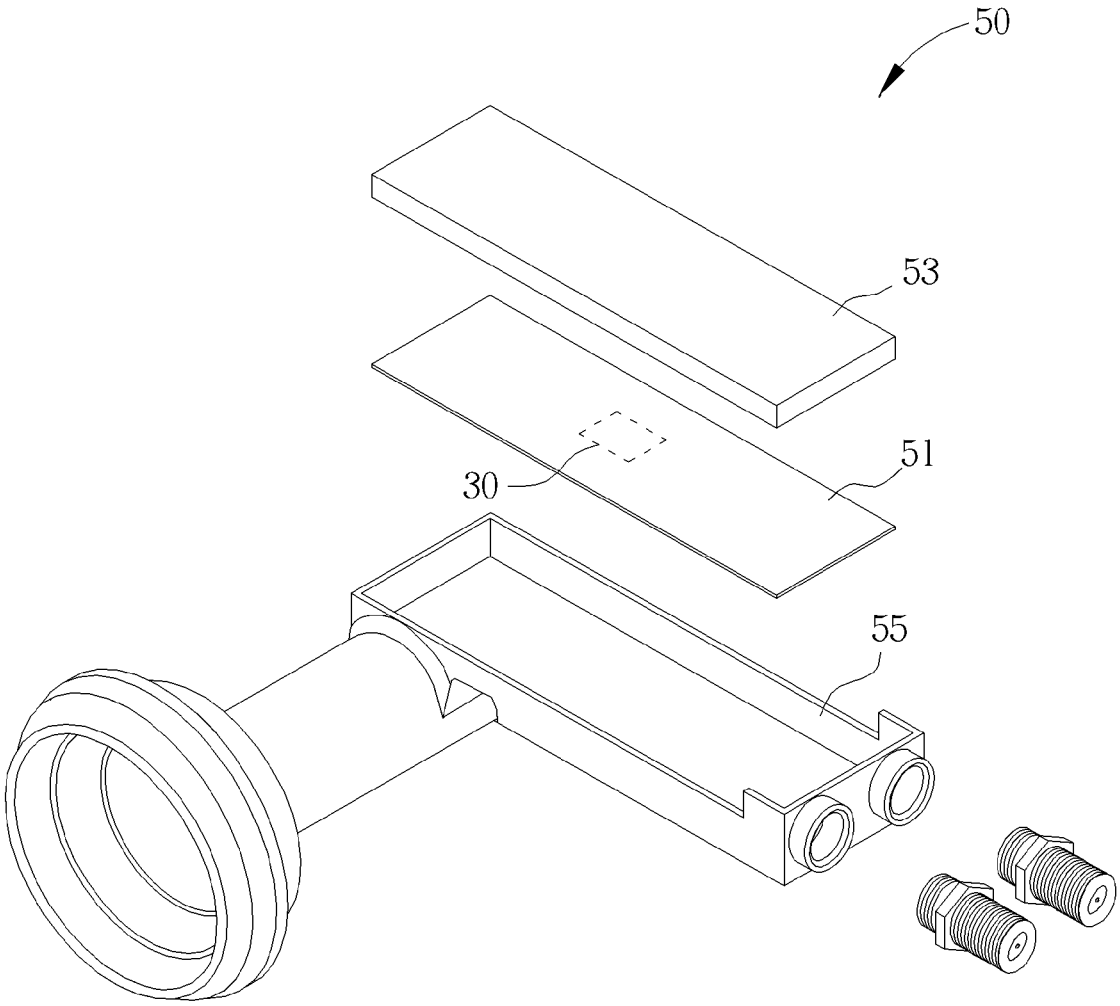
FIG. 5A is an appearance diagram of an LNB according to an embodiment of the present invention.
Figure 5B:
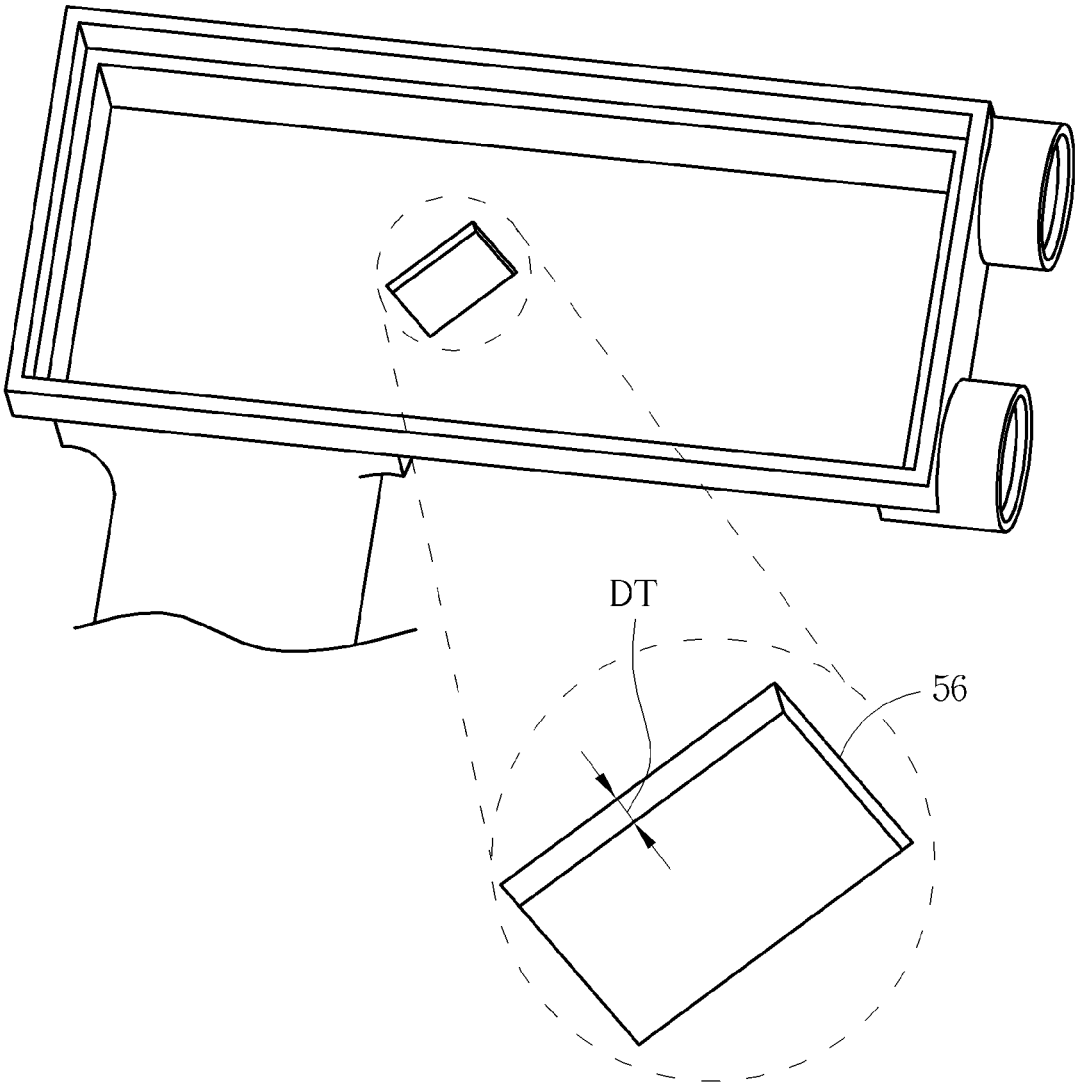
FIG. 5B is part of the appearance diagram of the LNB shown in FIG. 5.

Please refer to FIG. 5A and FIG. 5B. FIG. 5A is an appearance diagram of an LNB 50 according to an embodiment of the present invention. FIG. 5B is part of the appearance diagram of the LNB 50. As shown in FIG. 5A, the LNB 50 includes a circuit board 51, a spacer 53 and a housing 55. A circuit board structure 30 may be formed on the circuit board 51, the circuit board 51 may be disposed between the housing 55 and the spacer 53 to cover the circuit board structure 30.

Noticeably, as shown in FIG. 5B, a slot area 56 may be formed on the housing 55 for containing the first substrate 31 of the circuit board structure 30. There is a slot height DT, e.g. 1.1 mm, of the slot area 56, such that the housing 55 may shield or block electromagnetic radiations from the RF signals SV and SH.

To sum up, compared with the traditional LNB 10 shown in FIG. 2, the LNB 50 of the present invention may be realized by one circuit board 51 and one spacer 53, which may save the cost for producing circuit boards, time and labor for assembling the thru pins 16, as well as ensure the stability of production. A weight and a volume of the LNB 50 may be lighter and smaller than a weight and a volume of the LNB 10 shown in FIG. 2, which may improve a convenience for installing a television satellite system. Besides, the circuit board structure 30 is designed according to CoPlanar Waveguide principle, a designer may adjust a wire width and a dielectric coefficient of the substrate to design a proper transmission line and ensure the insertion loss, the return loss and the isolation. The housing and the spacer may enhance an ability of the LNB 50 to shield or block the electromagnetic radiation of the RF signal, mitigate the coupling effect or crosstalk between the RF signals to improve an SNR (Signal-to-Noise Ratio) of the LNB.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A circuit board structure for a low noise block down-converter, and used for transmitting a first radio-frequency signal and a second radio-frequency signal across each other, comprising:

a first substrate comprising:

a first wire for transmitting the first radio-frequency signal;

a first grounded wire formed in parallel to one side of the first wire, two ends of the first grounded wire are respectively electrically connected to a first via and a second via; and a second grounded wire formed in parallel to another side of the first wire, two ends of the second grounded wire are respectively electrically connected to a third via and a fourth via; and a second substrate electrically connected to the first substrate, and comprising:

a second wire for transmitting the second radio-frequency signal;

a third wire formed on one side of the second wire, and electrically connected to one end of the first wire by a fifth via to transmit the first radio-frequency signal; and a fourth wire formed on another side of the second wire, and electrically connected to another end of the first wire by a sixth via to transmit the first radio-frequency signal;

wherein the third wire and the fourth wire are indirectly connected to each other, and the first, second, third, fourth, fifth and sixth vias penetrate the first substrate and the second substrate.

2. The circuit board structure of claim 1, further comprising a spacer disposed on the second substrate, wherein the spacer comprises:

a first separation unit formed between the second wire and the third wire, the first separation unit is electrically connected to one end of the first grounded wire by the first via, and electrically connected to one end of the second grounded wire by the third via; and a second separation unit formed between the second wire and the fourth wire, the second separation unit is electrically connected to another end of the first grounded wire by the second via, and electrically connected to another end of the second grounded wire by the fourth via;

wherein the first separation unit and the second separation unit are used for shielding or blocking electromagnetic radiations from the first radio-frequency signal and the second radio-frequency signal to prevent the first radio-frequency signal and the second radio-frequency signal from interfering with each other.

3. The circuit board structure of claim 2, wherein the first substrate comprises a first surface on which the first wire, the first grounded wire and the second grounded wire are formed.

4. The circuit board structure of claim 3, wherein the first substrate comprises a second surface and a grounded area, the grounded area is formed on the second surface, and electrically connected to the first separation unit and the second separation unit by the first, second, third and fourth vias.

5. The circuit board structure of claim 2, wherein the second substrate comprises a first surface and a grounded area, the grounded area is formed on the first surface, and electrically connected to the first separation unit and the second separation unit by the first, second, third and fourth vias.

6. The circuit board structure of claim 5, wherein the second substrate comprises a second surface on which the second wire, the third wire and the fourth wire are formed, and the spacer is disposed on the second surface.

7. The circuit board structure of claim 2, wherein the first and second separation units have a height, such that the first and second separation units are able to shield or block the electromagnetic radiations from the first radio-frequency signal and the second radio-frequency signal.

8. A low noise block down-converter, comprising:

a circuit board structure for a low noise block down-converter, and used for transmitting a first radio-frequency signal and a second radio-frequency signal across each other, comprising:

a first substrate comprising:

a first wire for transmitting the first radio-frequency signal;

a first grounded wire formed in parallel to one side of the first wire, two ends of the first grounded wire are respectively electrically connected to a first via and a second via; and a second grounded wire formed in parallel to another side of the first wire, two ends of the second grounded wire are respectively electrically connected to a third via and a fourth via; and a second substrate electrically connected to the first substrate, and comprising:

a second wire for transmitting the second radio-frequency signal;

a third wire formed on one side of the second wire, and electrically connected to one end of the first wire by a fifth via to transmit the first radio-frequency signal; and a fourth wire formed on another side of the second wire, and electrically connected to another end of the first wire by a sixth via to transmit the first radio-frequency signal; and a housing for covering the circuit board structure;

wherein the third wire and the fourth wire are indirectly connected to each other, and the first, second, third, fourth, fifth and sixth vias penetrate the first substrate and the second substrate.

9. The low noise block down-converter of claim 8, wherein the circuit board structure further comprises a spacer disposed on the second substrate, the spacer comprises:

a first separation unit formed between the second wire and the third wire, the first separation unit is electrically connected to one end of the first grounded wire by the first via, and electrically connected to one end of the second grounded wire by the third via; and a second separation unit formed between the second wire and the fourth wire, the first separation unit is electrically connected to another end of the first grounded wire by the second via, and electrically connected to another end of the second grounded wire by the fourth via;

wherein the first separation unit and the second separation unit are used for shielding or blocking electromagnetic radiations from the first radio-frequency signal and the second radio-frequency signal to prevent the first radio-frequency signal and the second radio-frequency signal from interfering with each other.

10. The low noise block down-converter of claim 9, wherein the first substrate comprises a first surface on which the first wire, the first grounded wire and the second grounded wire are formed.

11. The low noise block down-converter of claim 10, wherein the first substrate comprises a second surface and a grounded area, the grounded area is formed on the second surface, and electrically connected to the first separation unit and the second separation unit by the first, second, third and fourth vias.

12. The low noise block down-converter of claim 9, wherein the second substrate comprises a first surface and a grounded area, the grounded area is formed on the first surface, and electrically connected to the first separation unit and the second separation unit by the first, second, third and fourth vias.

13. The low noise block down-converter of claim 12, wherein the second substrate comprises a second surface on which the second wire, the third wire and the fourth wire are formed, and the spacer is disposed on the second surface.

14. The low noise block down-converter of claim 9, wherein the first and second separation units have a height, such that the first and second separation unit are able to shield or block the electromagnetic radiations from the first radio-frequency signal and the second radio-frequency signal.

15. The low noise block down-converter of claim 8, wherein a slot area is formed on the housing for containing the first substrate.

16. The low noise block down-converter of claim 15, wherein the slot area has a slot height, such that the first, second separation unit are able to shield or block electromagnetic radiations from the first radio-frequency signal and the second radio-frequency signal.

* * * * *